US009423104B2

(12) United States Patent
Durkee et al.

(10) Patent No.: US 9,423,104 B2
(45) Date of Patent: Aug. 23, 2016

(54) LINEAR SOLID STATE LIGHTING FIXTURE WITH ASYMMETRIC LIGHT DISTRIBUTION

(71) Applicant: CREE, INC., Durham, NC (US)

(72) Inventors: John Durkee, Raleigh, NC (US); Dong Lu, Cary, NC (US); Paul Kenneth Pickard, Morrisville, NC (US); William Laird Dungan, Cary, NC (US); Gary David Trott, Morrisville, NC (US)

(73) Assignee: CREE, INC., Durham, NC (US)

( * ) Notice: Subject to any disclaimer, the term of this patent is extended or adjusted under 35 U.S.C. 154(b) by 336 days.

(21) Appl. No.: 13/830,698

(22) Filed: Mar. 14, 2013

(65) Prior Publication Data

US 2014/0268721 A1 Sep. 18, 2014

(51) Int. Cl.

| | |
|---|---|
| ***F21V 7/04*** | (2006.01) |
| ***F21V 13/04*** | (2006.01) |
| ***F21V 29/70*** | (2015.01) |
| ***F21S 8/04*** | (2006.01) |
| ***F21V 5/02*** | (2006.01) |
| ***F21V 5/08*** | (2006.01) |
| ***F21V 7/00*** | (2006.01) |
| *F21Y 101/02* | (2006.01) |
| *F21Y 113/00* | (2016.01) |

(52) U.S. Cl.

CPC ..... *F21V 13/04* (2013.01); *F21S 4/28* (2016.01); *F21S 8/04* (2013.01); *F21V 5/02* (2013.01); *F21V 5/08* (2013.01); *F21V 7/0008* (2013.01); *F21V 29/70* (2015.01); *F21Y 2101/02* (2013.01); *F21Y 2113/005* (2013.01)

(58) Field of Classification Search

CPC ... F21Y 2103/003; F21S 4/003; F21S 4/008; F21V 7/005; F21V 7/0008; F21V 7/04; F21V 29/004

See application file for complete search history.

(56) References Cited

U.S. PATENT DOCUMENTS

| | | | | |
|---|---|---|---|---|
| 4,748,543 A * | 5/1988 | Swarens | ..... | 362/147 |
| 5,199,782 A * | 4/1993 | Johnson et al. | ..... | 362/147 |
| 5,823,663 A | 10/1998 | Bell et al. | ..... | 362/362 |
| 6,210,025 B1 | 4/2001 | Schmidt et al. | ..... | 362/362 |

(Continued)

FOREIGN PATENT DOCUMENTS

| | | |
|---|---|---|
| DE | 102007030186 | 1/2009 |
| DE | 202010001832 | 7/2010 |

(Continued)

OTHER PUBLICATIONS

U.S. Appl. No. 13/345,215, filed Jan. 6, 2012, Lu, et al.

(Continued)

*Primary Examiner* — Ismael Negron

(74) *Attorney, Agent, or Firm* — Koppel, Patrick, Heybl & Philpott

(57) ABSTRACT

The fixture includes an elongated back reflector along the longitudinal direction of the fixture and at least one light source mounted to a heat sink structure and arranged to emit at least a portion of light toward the back reflector. The back reflector redirects at least a portion of the light toward an exit lens which interacts with the light as it is emitted from the fixture. Both the shape of the individual fixture elements (e.g., the back reflector and the exit lens) and the arrangement of these elements provide an asymmetrical light output distribution. Various mount mechanisms may be used to attach the fixture to a surface such as a ceiling or a wall, or the fixture may be suspended from a in a pendant configuration.

51 Claims, 12 Drawing Sheets

(56) References Cited

U.S. PATENT DOCUMENTS

| | | | | |
|---|---|---|---|---|
| 6,257,737 | B1 * | 7/2001 | Marshall et al. | 362/231 |
| 6,808,299 | B2 * | 10/2004 | Wijbenga et al. | 362/516 |
| 7,049,761 | B2 | 5/2006 | Timmermans et al. | 315/246 |
| 7,213,940 | B1 | 5/2007 | Van de Ven et al. | 362/231 |
| 7,217,009 | B2 * | 5/2007 | Klose | 362/297 |
| 7,237,925 | B2 * | 7/2007 | Mayer et al. | 362/247 |
| 7,510,299 | B2 | 3/2009 | Timmermans et al. | 362/225 |
| 7,591,578 | B2 * | 9/2009 | Chang | 362/612 |
| 7,594,736 | B1 | 9/2009 | Kassay et al. | |
| 7,607,794 | B1 * | 10/2009 | Thompson | 362/147 |
| 7,654,702 | B1 | 2/2010 | Ding et al. | |
| 7,712,918 | B2 | 5/2010 | Siemiet et al. | 362/241 |
| 7,722,220 | B2 | 5/2010 | Van de Ven | 362/294 |
| 7,768,192 | B2 | 8/2010 | Van de Ven et al. | 313/503 |
| 7,815,338 | B2 | 10/2010 | Siemiet et al. | 362/218 |
| 8,038,321 | B1 * | 10/2011 | Franck et al. | 362/249.02 |
| 8,092,049 | B2 | 1/2012 | Kinnune et al. | 362/294 |
| 8,113,680 | B2 * | 2/2012 | O'Brien et al. | 362/147 |
| 8,197,105 | B2 * | 6/2012 | Yang | 362/346 |
| 8,201,968 | B2 | 6/2012 | Maxik et al. | |
| 8,240,877 | B2 * | 8/2012 | Kim et al. | 362/225 |
| 2004/0001344 | A1 | 1/2004 | Hecht | |
| 2005/0264716 | A1 | 12/2005 | Kim et al. | |
| 2007/0109779 | A1 | 5/2007 | Sekiguchi et al. | |
| 2007/0115670 | A1 | 5/2007 | Roberts et al. | |
| 2007/0115671 | A1 | 5/2007 | Roberts et al. | |
| 2008/0049422 | A1 | 2/2008 | Trenchard et al. | |
| 2008/0204888 | A1 * | 8/2008 | Kan et al. | 359/629 |
| 2008/0232093 | A1 | 9/2008 | Kim | |
| 2009/0225543 | A1 | 9/2009 | Roberts et al. | |
| 2009/0237958 | A1 | 9/2009 | Kim | |
| 2009/0323334 | A1 | 12/2009 | Roberts et al. | |
| 2010/0110679 | A1 | 5/2010 | Teng et al. | |
| 2010/0188609 | A1 | 7/2010 | Matsuki et al. | |
| 2010/0254128 | A1 | 10/2010 | Pickard et al. | |
| 2010/0254145 | A1 | 10/2010 | Yamaguchi | |
| 2010/0254146 | A1 | 10/2010 | McCanless | |
| 2011/0156584 | A1 | 6/2011 | Kim | |
| 2011/0199005 | A1 | 8/2011 | Bretschneider et al. | |
| 2011/0199769 | A1 | 8/2011 | Bretschneider et al. | |
| 2012/0038289 | A1 | 2/2012 | Jee et al. | |
| 2012/0051041 | A1 | 3/2012 | Edmond et al. | |
| 2012/0140464 | A1 | 6/2012 | Huang et al. | |

FOREIGN PATENT DOCUMENTS

| | | | |
|---|---|---|---|
| EP | 1298383 | A2 | 4/2003 |
| EP | 1357335 | A2 | 10/2003 |
| EP | 1653254 | | 3/2006 |
| EP | 1737051 | | 12/2006 |
| EP | 1847762 | A2 | 10/2007 |
| EP | 1860467 | | 11/2007 |
| JP | 2002244027 | | 11/2002 |
| JP | 2004140327 | | 5/2004 |
| JP | 2011018571 | | 8/2011 |
| JP | 2011018572 | | 8/2011 |
| WO | WO 03102467 | | 12/2003 |
| WO | WO 2009140761 | A1 | 11/2009 |
| WO | WO 2009157999 | A1 | 12/2009 |
| WO | WO 2010042216 | A2 | 4/2010 |
| WO | WO 2011074424 | A1 | 6/2011 |
| WO | WO 2011096098 | A1 | 8/2011 |
| WO | WO 2011098191 | | 8/2011 |
| WO | WO 2011118991 | A2 | 9/2011 |
| WO | WO 2011140353 | A2 | 11/2011 |

OTHER PUBLICATIONS

U.S. Appl. No. 13/442,311, filed Apr. 9, 2012, Lu, et al.
U.S. Appl. No. 13/453,924, filed Apr. 23, 2012, Pickard, et al.
U.S. Appl. No. 12/463,709, filed May 11, 2009, Donofrio, et al.
U.S. Appl. No. 11/656,759, filed Jan. 22, 2007, Chitnis, et al.
U.S. Appl. No. 11/899,790, filed Sep. 7, 2007, Chitnis, et al.
U.S. Appl. No. 13/088,690, filed Apr. 18, 2011, Pickard, et al.
U.S. Appl. No. 13/672,592, filed Nov. 8, 2012, Dixon, et al.
WhiteOpticsTM (New Castle, DE) White97 Film . . . Technical Data Sheet, 1 page.
WhiteOpticsTM (New Castle, DE) Metal, Technical Data Sheet, 1 page.
International Search Report and Written Opinion from PCT Application No. PCT/US2013/021053, dated Apr. 17, 2013.
U.S. Appl. No. 13/649,052, filed Oct. 10, 2012, Lowes, et al.
U.S. Appl. No. 13/649,067, filed Oct. 10, 2012, Lowes, et al.
U.S. Appl. No. 13/207,204, filed Aug. 10, 2011, Athalye, et al.
U.S. Appl. No. 13/365,844.
U.S. Appl. No. 13/662,618, filed Oct. 29, 2012.
U.S. Appl. No. 13/462,388, filed May 2, 2012.
XLamp® C family from Cree®, Inc . . . Product Family Data Sheet, 15 pages.
XLamp® M family from Cree®, Inc . . . Product Family Data Sheet, 14 pages.
XLamp® X family from Cree®, Inc . . . Product Family Data Sheet, 17 pages.
Energy Star® Program Requirements for Solid State Lighting Luminaires, Eligibility Criteria—Version 1.1, final: Dec. 19, 2008.
Assist Recommends . . . LED Life for General Lighting: Definition of Life, vol. 1, Issue 1, Feb. 2005.
"IES Approved Method for Measuring Lumen Maintenance of LED light Sources", Sep. 22, 2008. ISBN No. 978-0-87995-227-3, (LM-80).
Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
International Search Report and Written Opinion for PCT Application No. PCT/US2011/062396, dated Jul. 13, 2012.
Office Action from Japanese Design Patent Application No. 2011-18570.
Reason for Rejection from Japanese Design Patent Application No. 2011-18571.
Reason for Rejection from Japanese Design Patent Application No. 2011-18572.
U.S. Appl. No. 12/873,303, filed Aug. 31, 2010 to Edmond, et al.
U.S. Appl. No. 12/961,385, filed Dec. 6, 2010 to Pickard, et al.
Cree's XLamp XP-E LED's, data sheet, pp. 1-16.
Cree's XLamp XP-G LED's, data sheet, pp. 1-12.
International Search Report and Written Opinion for Patent Application No. PCT/US2011/001517, dated: Feb. 27, 2012.
U.S. Appl. No. 12/418,796, filed Apr. 6, 2009.
U.S. Appl. No. 13/429,080, filed Mar. 23, 2012.
U.S. Appl. No. 13/028,946, filed Feb. 16, 2011.
U.S. Appl. No. 13/306,589, filed Nov. 29, 2011.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
Office Action from U.S. Appl. No. 29/449,309, dated Jun. 10, 2014.
Response to OA from U.S. Appl. No. 29/449,309, filed Jul. 18, 2014.
Office Action from U.S. Appl. No. 29/449,318, dated Jun. 27, 2014.
International Search Report and Written Opinion from PCT/US2013/049225, dated Oct. 24, 2013.
Office Action from U.S. Appl. No. 29/449,309, dated Sep. 24, 2014.
Final Rejection issued in Korean Design Appl. No 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/US2013/035668, dated Jul. 12, 2013.

* cited by examiner

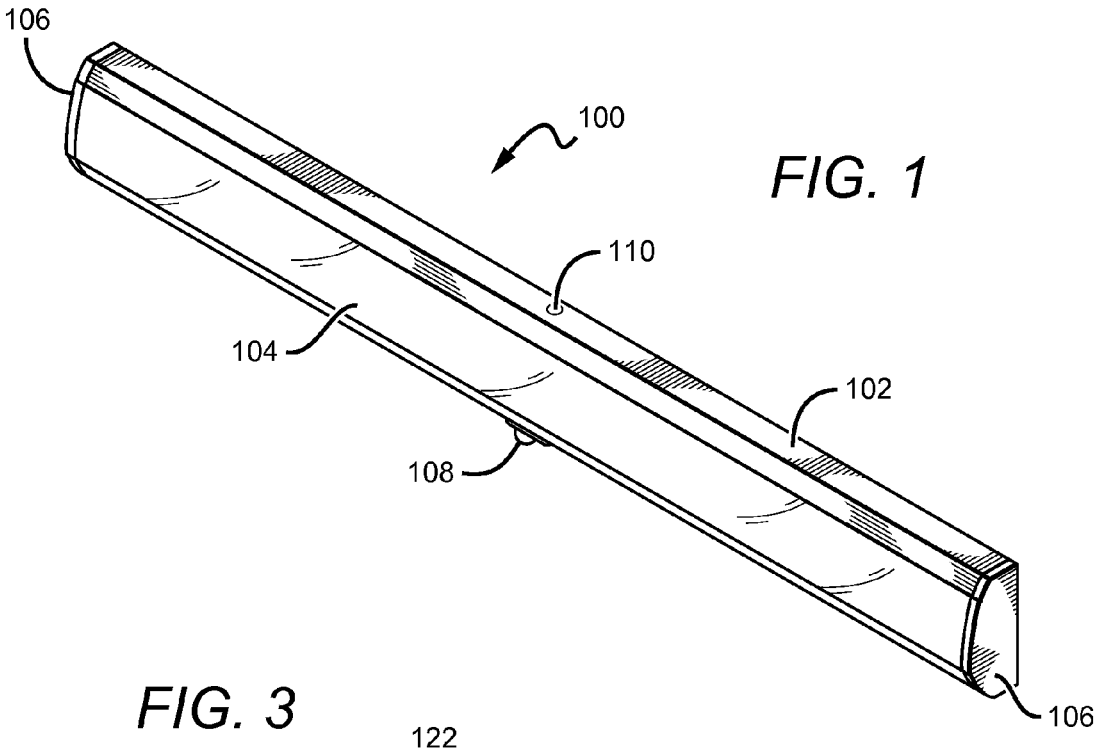
FIG. 1
FIG. 3
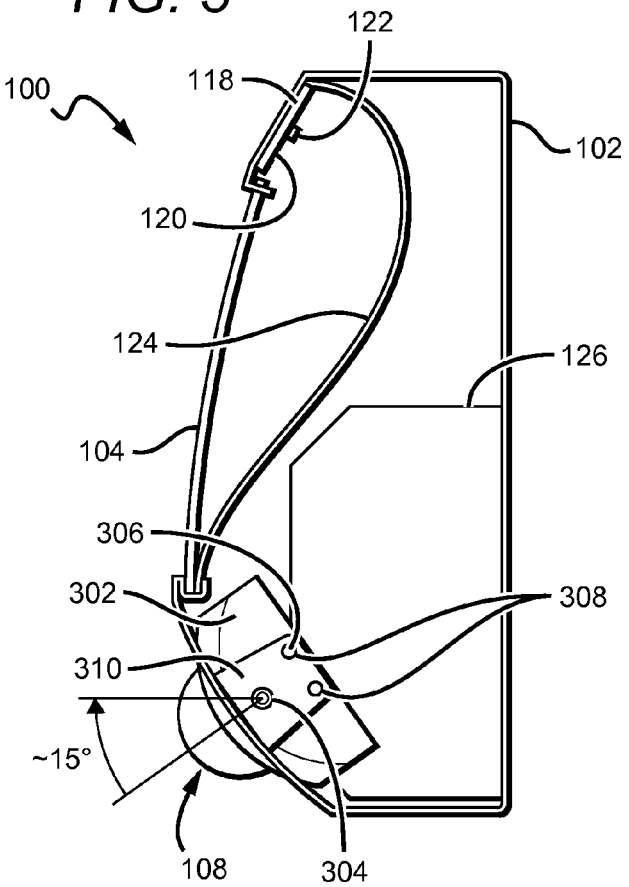

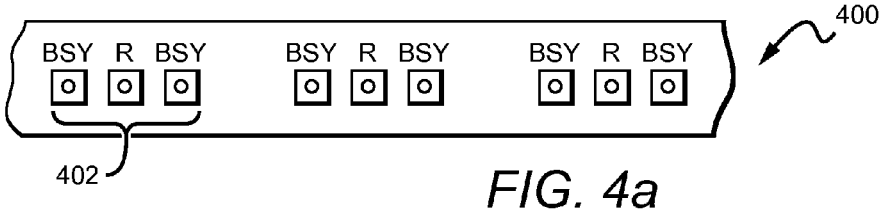
FIG. 4a
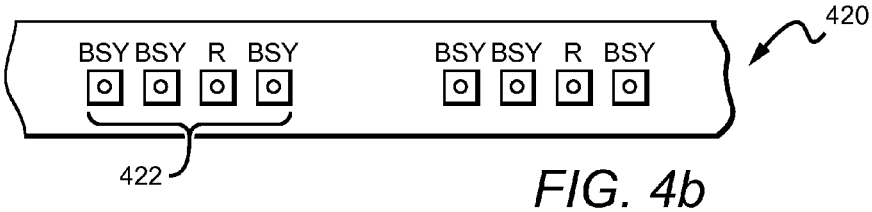
FIG. 4b
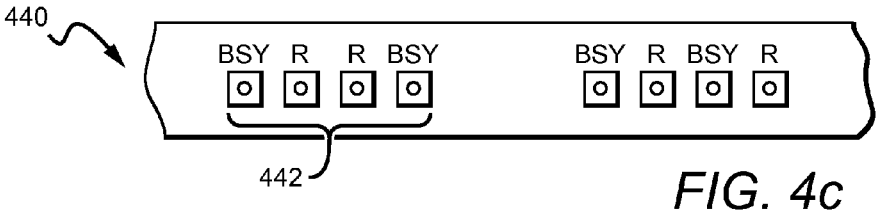
FIG. 4c
FIG. 5
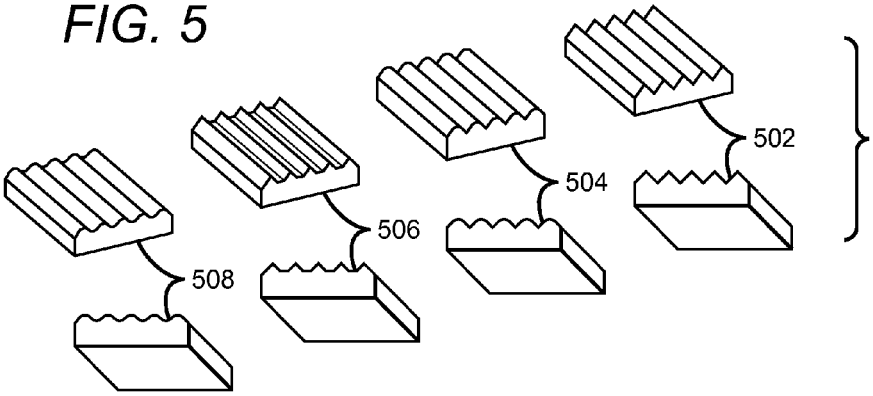
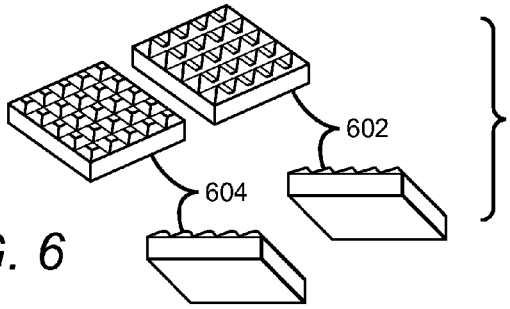
FIG. 6

FIG. 7
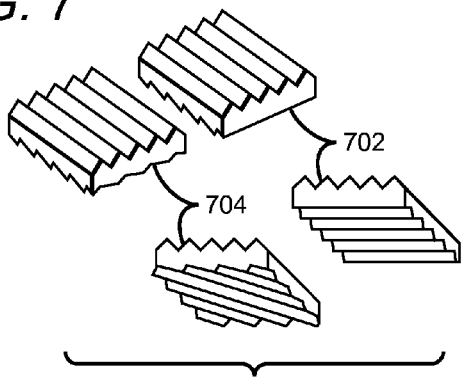
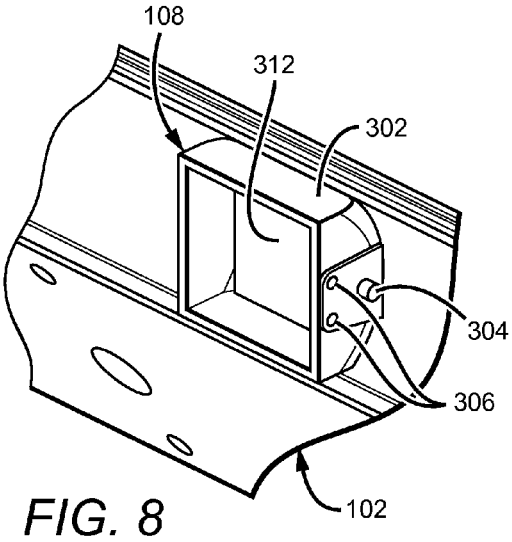
FIG. 8
FIG. 9
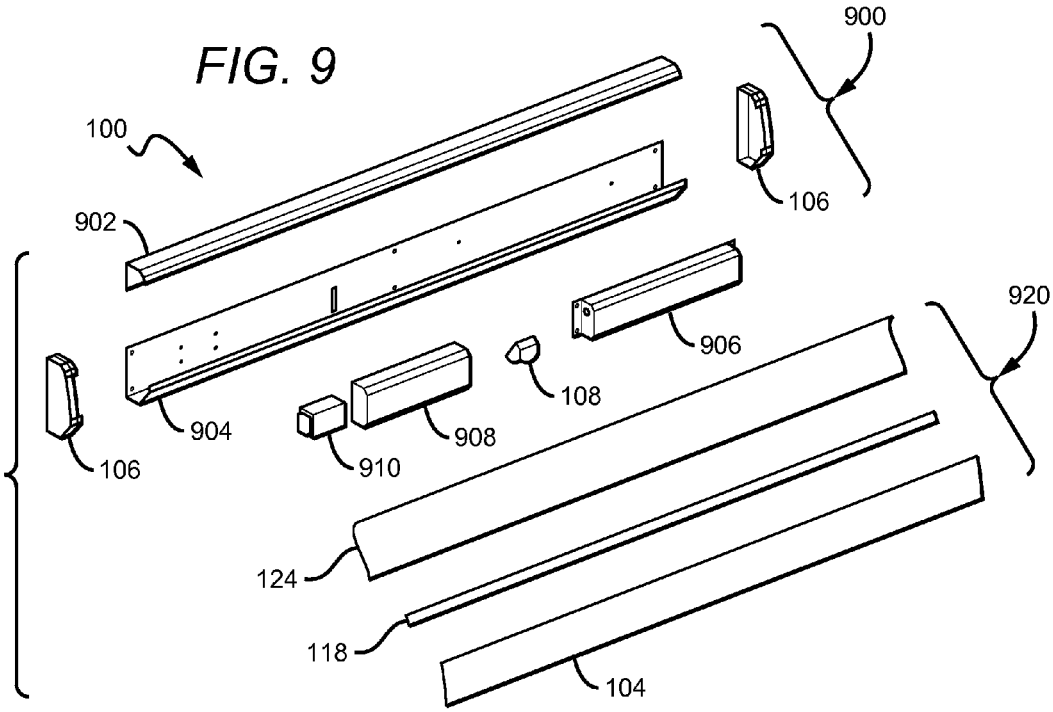

FIG. 10b
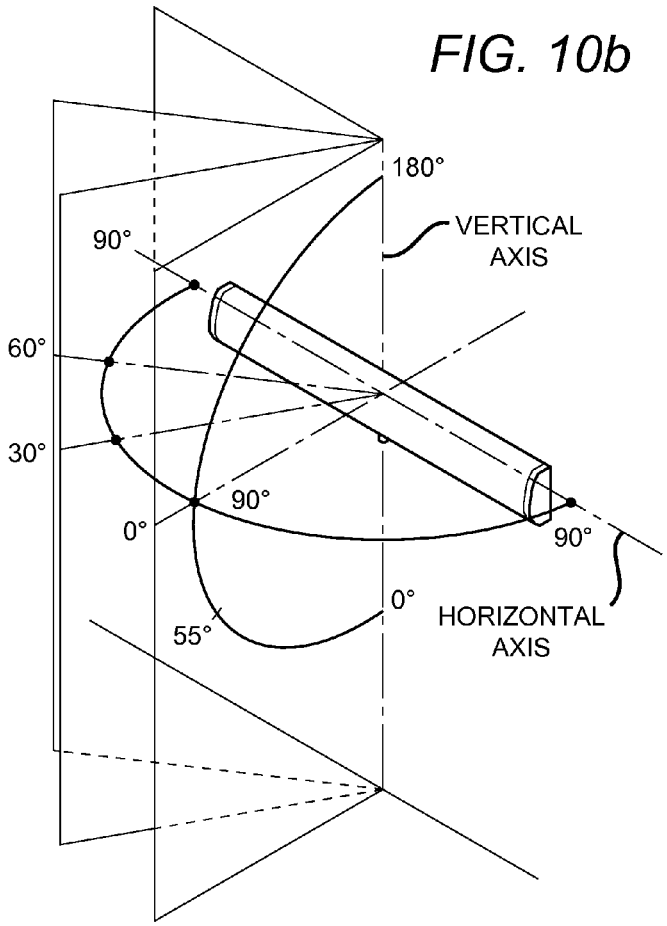
FIG. 12
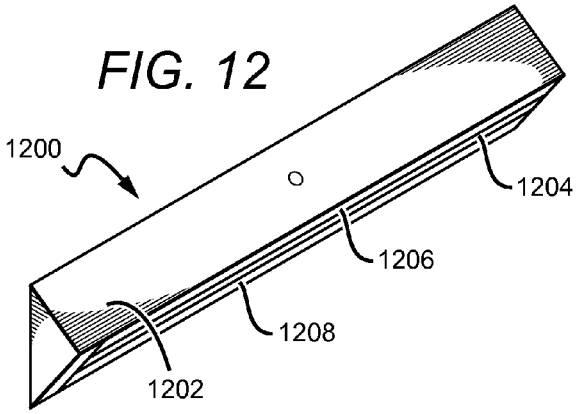
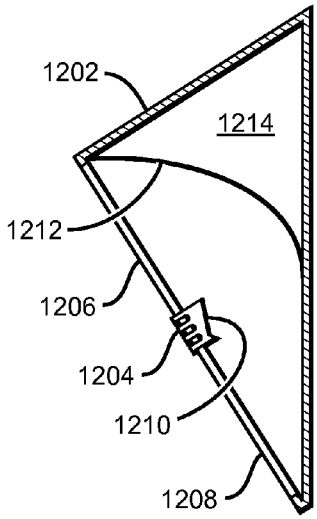
FIG. 13

FIG. 11
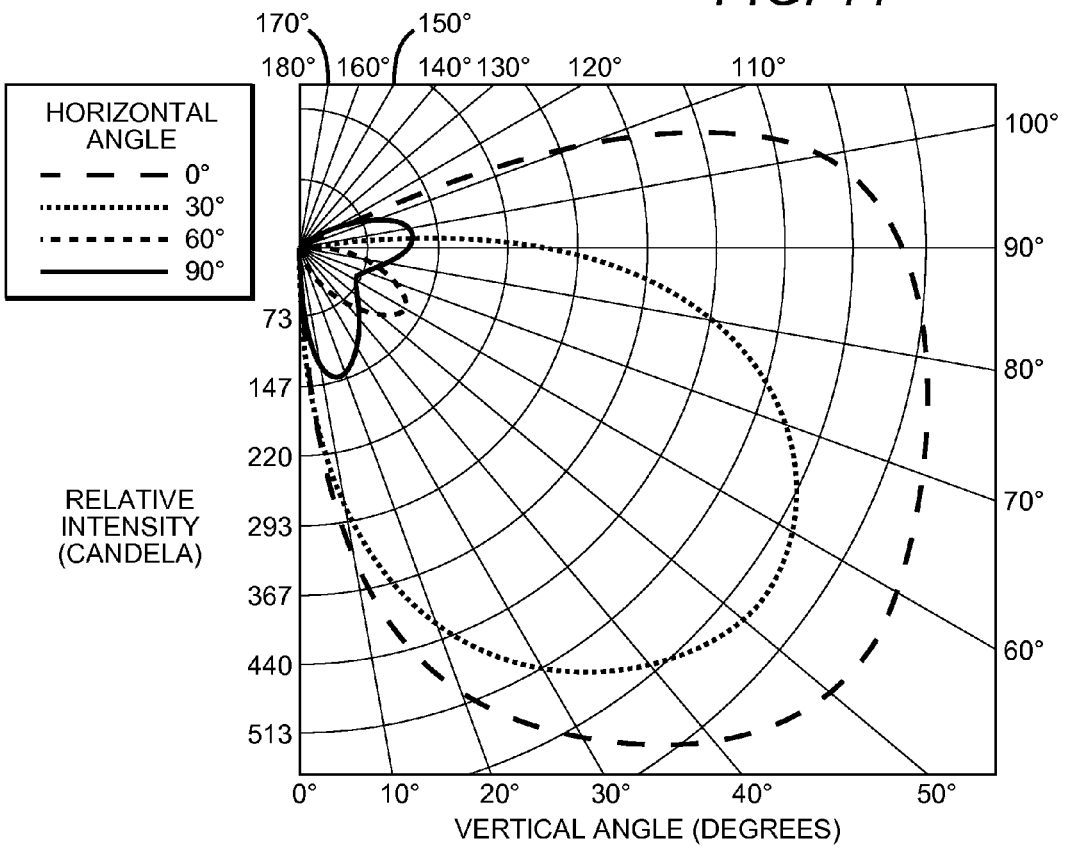
FIG. 14
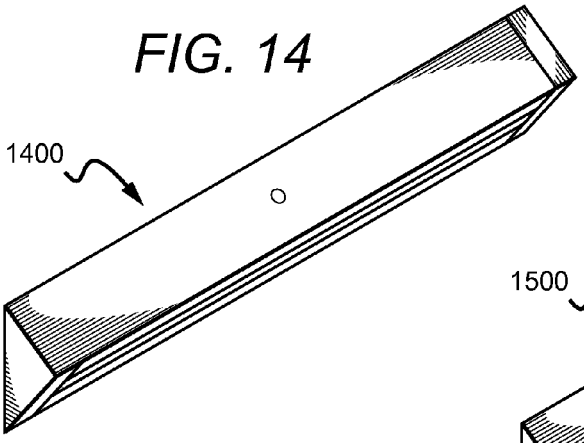
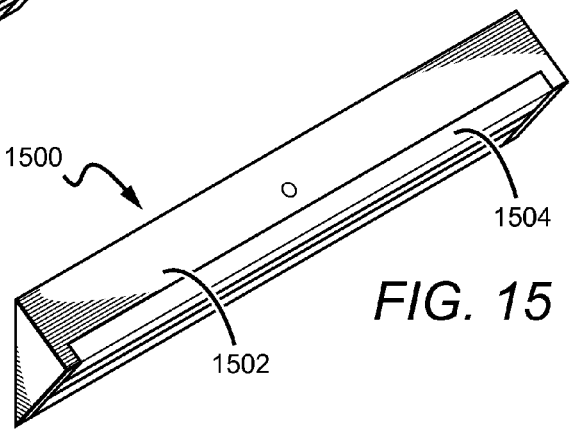
FIG. 15

FIG. 16
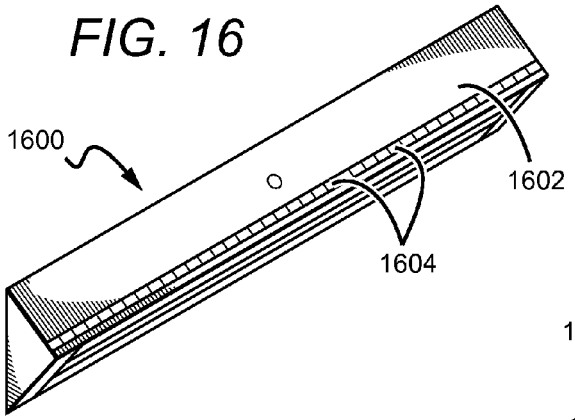
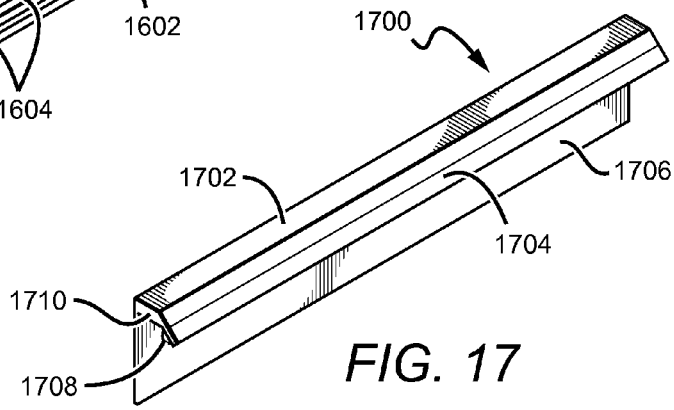
FIG. 17
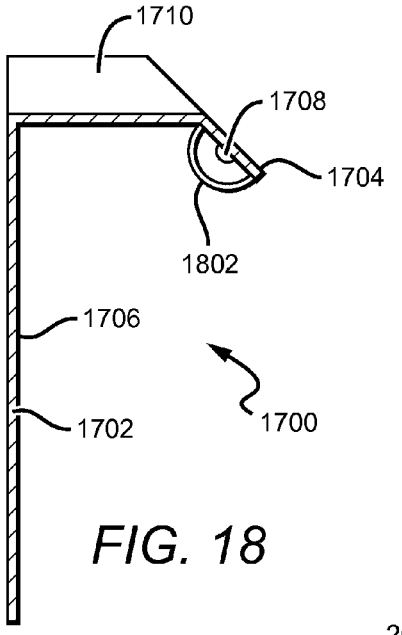
FIG. 18
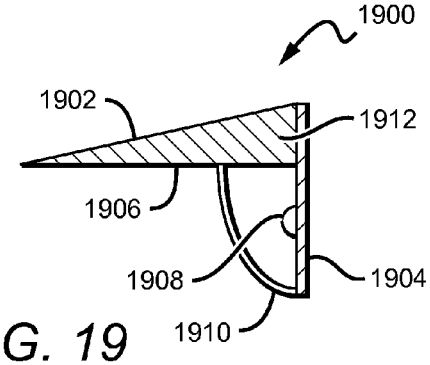
FIG. 19
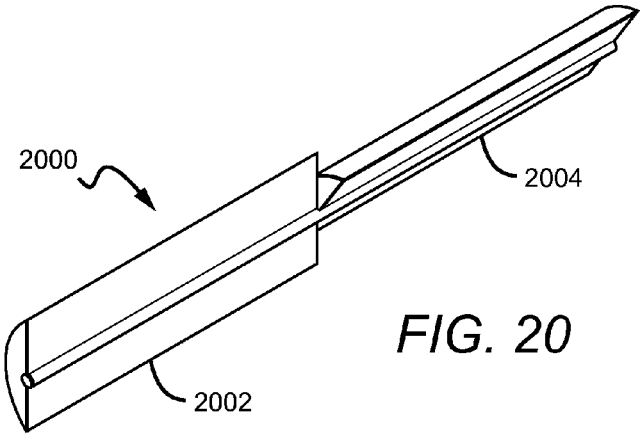
FIG. 20

LINEAR SOLID STATE LIGHTING FIXTURE WITH ASYMMETRIC LIGHT DISTRIBUTION

BACKGROUND OF THE INVENTION

1. Field of the Invention

The invention relates to troffer-style lighting fixtures and, more particularly, to troffer-style fixtures that are well-suited for use with solid state lighting sources, such as light emitting diodes (LEDs).

2. Description of the Related Art

Troffer fixtures are ubiquitous in commercial office and industrial spaces throughout the world. In many instances these troffers house elongated fluorescent light bulbs that span the length of the troffer. Troffers may be mounted to or suspended from ceilings or walls. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Some recent designs have incorporated an indirect lighting scheme in which the LEDs or other sources are arranged in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that which often extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY OF THE INVENTION

An embodiment of a light fixture comprises the following elements. At least one light source emits light that is incident on a back reflector. A first exit lens is arranged to receive at least some light redirected from the back reflector at least a portion of said back reflector. The light fixture provides an asymmetric light distribution.

An embodiment of a light fixture comprises the following elements. A back reflector is at least partially surrounded by a housing. A heat sink comprises a mount surface. A plurality of light sources are on the mount surface, the light sources arranged to emit light such that at least a portion of light from the light sources is initially incident on the back reflector. The back reflector is asymmetric relative to the primary emission direction.

An embodiment of a light fixture comprises the following elements. A back reflector is at least partially surrounded by a housing. A mount surface is proximate to the back reflector. An exit lens extending between the back reflector and the mount surface. At least one light source is on the mount surface and arranged to emit light such that a first portion of the light initially impinges on the back reflector and a second portion of the light initially impinges on the exit window.

An embodiment of an elongated light fixture comprises the following elements. The fixture includes a lighting subassembly and an electronics assembly. The lighting assembly comprises: a lens plate; an asymmetric back reflector; a heat sink comprising a mount surface; at least one light source on the mount surface and arranged to emit toward the back reflector, the back reflector arranged to redirect at least a portion of impinging light toward the lens plate; and end caps on both ends of the lens plate, the back reflector, and the heat sink, the end caps holding the lens plate, the back reflector, and the heat sink in position relative to one another. The electronics subassembly comprises the following elements: an elongated housing at least partially defines an internal cavity. Driver electronics are mounted to the housing within the cavity. The lighting subassembly attaches to the electronics subassembly such that the back reflector and the at least one light source are disposed within the internal cavity.

BRIEF DESCRIPTION OF THE DRAWINGS

FIG. 1 is a perspective view of a light fixture according to an embodiment of the present invention.

FIG. 2*a* (bottom view); FIG. 2*b* (front view); FIG. 2*c* (top view); FIG. 2*d* (back view); FIG. 2*e* (right side view); and FIG. 2*f* (left side view).

FIG. 3 is a right side cut-away view of the fixture along cut-line A-A (shown in FIG. 2*c*).

FIGS. 4*a-c* show a top plan view of portions of several light strips 400, 420, 440 that may be used in embodiments of the present invention.

FIG. 5 shows various lens textures that may be used for an exit lens in embodiments of the present invention.

FIG. 6 shows lens textures that may be used in embodiments of the present invention.

FIG. 7 shows lens textures that may be used in embodiments of the present invention.

FIG. 8 shows a perspective view of the back side of a sensor that may be used in embodiments of the present invention.

FIG. 9 shows one embodiment of an electronics subassembly and a lighting subassembly that may be used in embodiments of the present invention.

FIG. 10*b* shows how the horizontal and vertical axes are oriented with respect to the graph in FIG. 11.

FIG. 11 is a graph modeling possible light output from a fixture according to an embodiment of the present invention.

FIG. 12 is a perspective view of a fixture according to another embodiment of the present invention.

FIG. 13 is a cross-sectional view of a fixture according to an embodiment of the present invention.

FIG. 14 is a perspective view of another fixture according to an embodiment of the present invention.

FIG. 15 is a perspective view of another fixture according to an embodiment of the present invention.

FIG. 16 is a perspective view of another fixture according to an embodiment of the present invention.

FIG. 17 is a perspective view of another fixture according to an embodiment of the present invention.

FIG. 18 is a cross-sectional view of a fixture according to an embodiment of the present invention.

FIG. 19 shows a cross-sectional view of another fixture according to an embodiment of the present invention.

FIG. 20 shows a bidirectional fixture according to an embodiment of the present invention.

DETAILED DESCRIPTION OF THE INVENTION

Figures 2A, 2B, 2C, 2D, 2E, 2F:
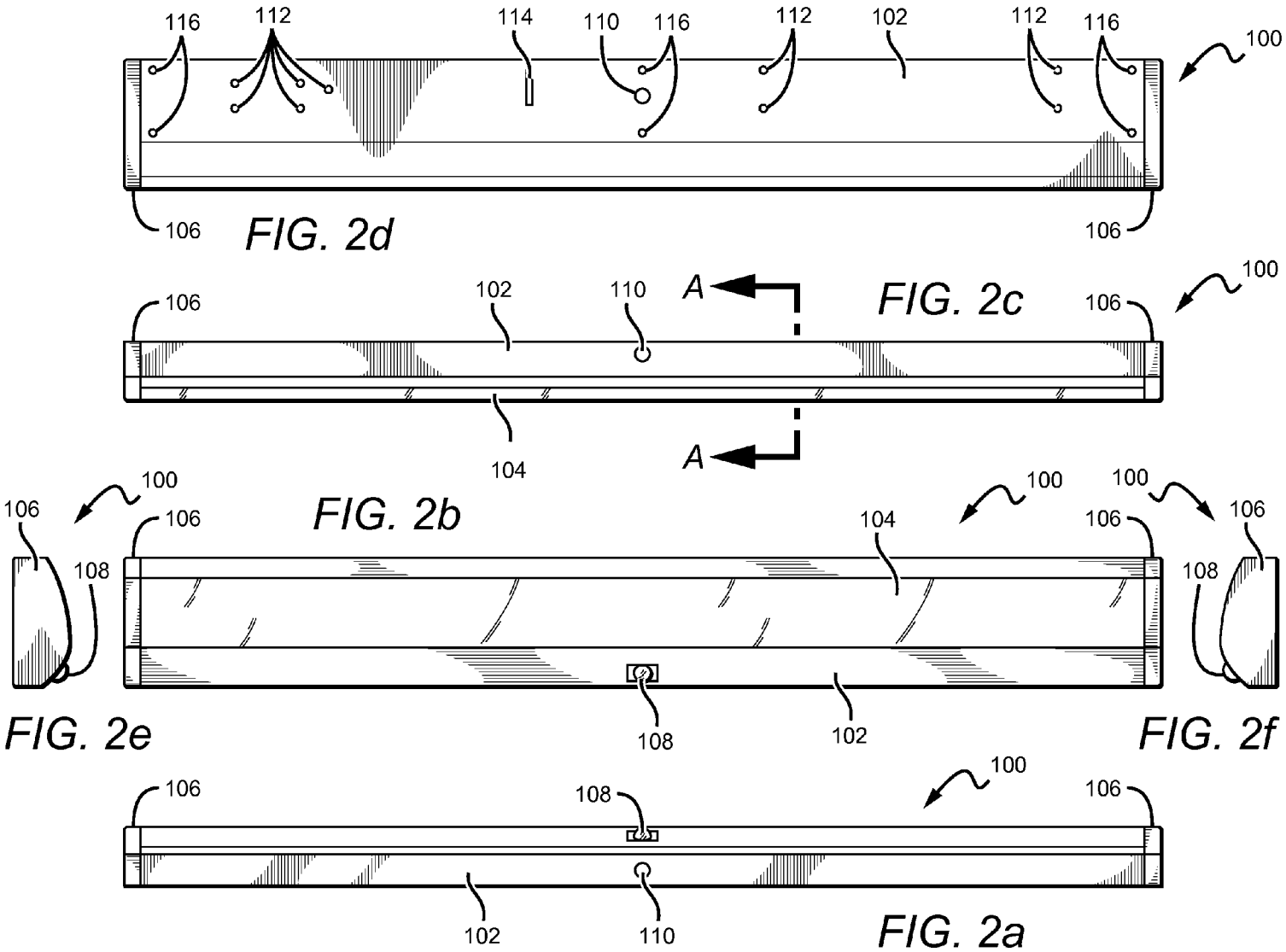
FIGS. 2*a-f* show six different views of a fixture according to an embodiment of the present invention.

Embodiments of the present invention provide an indirect troffer-style fixture that is particularly well-suited for use with solid state light sources, such as LEDs. The fixture comprises an elongated back reflector that runs along the longitudinal direction of the fixture. At least one light source is arranged to emit toward the back reflector. In some embodiments multiple light sources are mounted to a mount surface on a heat sink structure arranged so that at least a portion of the light emitted from the source(s) is initially incident on the back reflector which redirects at least a portion of the light toward an exit lens. The exit lens interacts with the light as it is emitted from the fixture. Both the shape of the individual fixture elements (e.g., the back reflector and the exit lens) and the arrangement of these elements provide an asymmetrical light output distribution.

Structural elements, such as a housing and end caps, may be used to hold the fixture elements in position relative to each other. Various mount mechanisms may be used to attach the fixture to a surface such as a ceiling or a wall.

FIG. 1 is a perspective view of a light fixture 100 according to an embodiment of the present invention. The fixture 100 is particularly well-suited for use with solid state light emitters, such as LEDs or vertical cavity surface emitting lasers (VCSELs), for example. However, other kinds of light sources may also be used. An elongated housing 102 provides the primary mechanical structure for the fixture 100. An exit lens 104 provides a transmissive window through which light is emitted. End caps 106 cover the ends of the housing 102 and hold the housing 102 and the exit lens 104 in place. The housing 102, exit lens 104, and end caps 106 define an internal cavity that houses several elements including the light sources and the driver electronics as shown in detail herein. In this embodiment a sensor 108 protrudes through the housing 102. Information from the sensor 108 is used to control the internal light sources. A feed hole 110 on the top panel of the housing 102 allows for electrical wires to be passed into internal cavity of the housing 102 to power the electronic components, the light sources, and the sensor 108. The wires can be fed into internal cavity of the housing 102 from an external J-box, for example.

FIGS. 2*a-f* show six different views of the fixture 100: FIG. 2*a* (bottom view); FIG. 2*b* (front view); FIG. 2*c* (top view); FIG. 2*d* (back view); FIG. 2*e* (right side view); and FIG. 2*f* (left side view). The housing 102 defines the general shape of the elongated fixture 100 and may be constructed from a metal such as aluminum, for example. In some embodiments, it may be desirable to use a material having good thermal conductivity to aid in dissipating heat from the internal light sources, although many different materials may be used. The housing 102 may be fabricated using an efficient and scalable extrusion process, although other manufacturing processes may also be used.

With reference to FIG. 2*d*, several holes and slots are cut into the bottom panel of the housing 102. In this particular embodiment, the smaller holes 112 and the slot 114 are used for mounting electronic elements, for example a driver circuit, to the internal surface of the housing 102. The larger holes 116 may be used to mount the fixture 100 to an external surface, such as a wall or a ceiling. The feed holes 110 on the top, bottom, and back surfaces of the housing 102 are sized to accommodate wire bundles. The positioning of the holes 110, 112, 116 and slot 114 are exemplary as many different hole/slot arrangements are possible to accommodate various internal element layouts.

With reference to FIGS. 2*e* and 2*f*, the end caps 106 are attached to the ends of the housing 102 using a snap-fit mechanism, screws, adhesives, or the like. The end caps 106 hold the panels of the housing 102 together and maintain the spacing of the internal elements, such as a back reflector and a heat sink, as discussed in detail herein.

FIG. 3 is a right side cut-away view of the fixture 100 along cut-line A-A (shown in FIG. 2*c*) to expose the internal cavity and the elements therein. The housing 102 provides the primary structural support for the fixture 100. An elongated heat sink 118 is disposed on an internal surface of the housing 102 proximate to a back reflector 124 and runs longitudinally along the housing 102. The heat sink 118 comprises a mount surface 120 on which at least one source 122 (e.g., LEDs) can be mounted. The terms "source" and "sources" are used interchangeably throughout this specification, and it is understood that the light source 122 may comprise one or more light emitters; thus, the terms do not limit any embodiment to a single or multiple emitter configuration. The sources 122 can be mounted on the mount surface 120 such that they emit at least some light in a direction toward the back reflector 124, or a certain portion thereof. The emitted light is then reflected off the back reflector 124 toward the exit lens 104. An electronic component box 126 within said housing 102 surrounds and protects the electronic components necessary to power and control the light sources 122.

In this particular embodiment, the back reflector 124 has a curved shape approximated by a spline curve. The shape has an asymmetric transverse cross-section. The back reflector 124 extends farther in the transverse direction on one side of the light source 122 than on the other side. The light source 122 is disposed off-center relative to a central longitudinal axis running through the center of the housing 102. Additionally, the light source 122 is arranged to emit in a primary direction at an angle that is off-center with respect to the back reflector 124. The positioning of the light source 122 and the asymmetric shape and placement of the back reflector 124 result in an asymmetric light distribution. Such an output is useful for lighting areas where more light is required in a given direction, such as stairwell, for example. In a stairwell it is important to light stairs that descend and/or ascend from a given level; thus, an asymmetric output distribution may be used to direct more of the light into these specific areas, reducing the total amount of light that is necessary to light such as an area.

The back reflector 124 can be constructed from many different materials. In one embodiment, the back reflector 124 comprises a material which allows it to be extruded for efficient, cost-effective production. Some acceptable materials include polycarbonates, such as Makrolon 6265X or FR6901 (commercially available from Bayer) or BFL4000 or BFL2000 (commercially available from Sabic). Many other materials may also be used to construct the back reflector 124. Using an extrusion process for fabrication, the back reflector 124 is easily scalable to accommodate lighting assemblies of varying length.

The back reflector 124 is an example of one shape that may be used in the fixture 100. The back reflector 124 may be designed to have several different shapes to perform particular optical functions, such as color mixing and beam shaping, for example. The back reflector 124 may be rigid, or it may be flexible in which case it may be held to a particular shape by compression against other surfaces. Emitted light may be bounced off of one or more surfaces. This has the effect of disassociating the emitted light from its initial emission angle. Output color uniformity typically improves with an increasing number of bounces, but each bounce has an associated optical loss. In some embodiments an intermediate diffusion mechanism (e.g., formed diffusers and textured lenses) may be used to mix the various colors of light.

The back reflector 124 should be highly reflective in the wavelength ranges emitted by the source(s) 122. In some embodiments, the reflector may be 93% reflective or higher. In other embodiments it may be at least 95% reflective or at least 97% reflective.

The back reflector 124 may comprise many different materials. For many indoor lighting applications, it is desirable to present a uniform, soft light source without unpleasant glare, color striping, or hot spots. Thus, the back reflector 124 may comprise a diffuse white reflector such as a microcellular polyethylene terephthalate (MCPET) material or a Dupont/WhiteOptics material, for example. Other white diffuse reflective materials can also be used.

Diffuse reflective coatings may be used on a surface of the back reflector to mix light from solid state light sources having different spectra (i.e., different colors). These coatings are particularly well-suited for multi-source designs where two different spectra are mixed to produce a desired output color point. For example, LEDs emitting blue light may be used in combination with other sources of light, e.g., yellow light to yield a white light output. A diffuse reflective coating may eliminate the need for additional spatial color-mixing schemes that can introduce lossy elements into the system; although, in some embodiments it may be desirable to use a diffuse surface in combination with other diffusive elements. In some embodiments, the surface may be coated with a phosphor material that converts the wavelength of at least some of the light from the light emitting diodes to achieve a light output of the desired color point.

By using a diffuse white reflective material for the back reflector 124 and by positioning the light sources to emit light first toward the back reflector 124 several design goals are achieved. For example, the back reflector 124 performs a color-mixing function, effectively doubling the mixing distance and greatly increasing the surface area of the source. Additionally, the surface luminance is modified from bright, uncomfortable point sources to a much larger, softer diffuse reflection. A diffuse white material also provides a uniform luminous appearance in the output. Harsh surface luminance gradients (max/min ratios of 10:1 or greater) that would typically require significant effort and heavy diffusers to ameliorate in a traditional direct view optic can be managed with much less aggressive (and lower light loss) diffusers achieving max/min ratios of 5:1, 3:1, or even 2:1.

The back reflector 124 can comprise materials other than diffuse reflectors. In other embodiments, the back reflector 124 can comprise a specular reflective material or a material that is partially diffuse reflective and partially specular reflective. In some embodiments, it may be desirable to use a specular material in one area and a diffuse material in another area. For example, a semi-specular material may be used on the center region with a diffuse material used in the side regions to give a more directional reflection to the sides. Many combinations are possible.

In this embodiment, the heat sink 118 is mounted to an internal surface of the housing 102 that is bent back toward the back reflector 124. The heat sink 500 can be constructed using many different thermally conductive materials. For example, the heat sink 500 may comprise an aluminum body. Similarly as the back reflector 124, the heat sink 500 can be extruded for efficient, cost-effective production and convenient scalability. In other embodiments, the heat sink 118 can be integrated with a printed circuit board (PCB), for example. Indeed the PCB itself may function as the heat sink, so long as the PCB is capable of handling thermal transmission of the heat load. Many other heat sink structures are possible.

The heat sink 118 can be mounted to the housing 102 using various methods such as, screws, pins, or adhesive, for example. In this particular embodiment, the heat sink 118 comprises an elongated thin rectangular body with a substantially flat area on which one or more light sources can be mounted. The flat area provides for good thermal communication between the heat sink 118 and the light sources 122 mounted thereon. In some embodiments, the light sources will be pre-mounted on light strips. FIGS. 4*a-c* show a top plan view of portions of several light strips 400, 420, 440 that may be used to mount multiple LEDs to the heat sink 118, and in some embodiments a sink may be integrated with the light strips 400, 420, 440. As previously mentioned, although LEDs are used as the light sources in various embodiments described herein, it is understood that other light sources, such as laser diodes for example, may be substituted in as the light sources in other embodiments.

Many industrial, commercial, and residential applications call for white light sources. The light fixture 100 may comprise one or more emitters producing the same color of light or different colors of light. In one embodiment, a multicolor source is used to produce white light. Several colored light combinations will yield white light. For example, it is known in the art to combine light from a blue LED with wavelength-converted yellow (blue-shifted-yellow or "BSY") light to yield white light with correlated color temperature (CCT) in the range between 5000K to 7000K (often designated as "cool white"). Both blue and BSY light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The BSY light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al.

The lighting strips 400, 420, 440 each represent possible LED combinations that result in an output spectrum that can be mixed to generate white light. Each lighting strip can include the electronics and interconnections necessary to power the LEDs. In some embodiments the lighting strip comprises a printed circuit board with the LEDs mounted and interconnected thereon. The lighting strip 400 includes clusters 402 of discrete LEDs, with each LED within the cluster 402 spaced a distance from the next LED, and each cluster 402 spaced a distance from the next cluster 402. If the LEDs within a cluster are spaced at too great distance from one another, the colors of the individual sources may become visible, causing unwanted color-striping. The clusters on the light strips can be compact. In some embodiments, an acceptable range of distances for separating consecutive LEDs within a cluster is not more than approximately 8 mm.

The scheme shown in FIG. 4*a* uses a series of clusters 402 having two blue-shifted-yellow LEDs ("BSY") and a single red LED ("R"). Once properly mixed the resultant output light will have a "warm white" appearance.

The lighting strip 420 includes clusters 422 of discrete LEDs. The scheme shown in FIG. 4*b* uses a series of clusters 422 having three BSY LEDs and a single red LED. This scheme will also yield a warm white output when sufficiently mixed.

The lighting strip 440 includes clusters 442 of discrete LEDs. The scheme shown in FIG. 4*c* uses a series of clusters 442 having two BSY LEDs and two red LEDs. This scheme will also yield a warm white output when sufficiently mixed.

The lighting schemes shown in FIGS. 4*a-c* are meant to be exemplary. Thus, it is understood that many different LED combinations can be used in concert with known conversion techniques to generate a desired output light color.

In this embodiment, very little, if any, of the light emitted from the sources 122 is directly incident on the exit lens 104. Instead, most of the light is first redirected off of the back reflector 124. This first bounce off the back reflector 124 mixes the light and reduces imaging of any of the discrete light sources 122. However, additional mixing or other kinds of optical treatment may still be necessary to achieve the desired output profile. Thus, the exit lens 104 may be designed to perform these functions as the light passes through it. This particular embodiment of the fixture 100 comprises the exit lens 104 which faces at least a portion of the back reflector 124 and extends across an opening in the housing 102 from a point adjacent to the edge of the heat sink 118 to a point where the back reflector attaches to the housing 102. The exit lens 104 can comprise many different elements and materials.

In one embodiment, the exit lens 104 comprises a diffusive element. A diffusive exit lens functions in several ways. For example, it can prevent direct visibility of the sources and provide additional mixing of the outgoing light to achieve a visually pleasing uniform source. However, a diffusive exit lens can introduce additional optical loss into the system. Thus, in embodiments where the light is sufficiently mixed by the back reflector 124 or by other elements, a diffusive exit lens may be unnecessary. In such embodiments, a transparent glass exit lens may be used, or the exit lens may be removed entirely. In still other embodiments, scattering particles may be included in the exit lens 104. Some embodiments may include a specular or partially specular back reflector. In such embodiments, it may be desirable to use a diffuse exit lens.

Diffusive elements in the exit lens 104 can be achieved with several different structures. A diffusive film inlay can be applied to the top- or bottom-side surface of the exit lens 104. It is also possible to manufacture the exit lens 104 to include an integral diffusive layer, such as by coextruding the two materials or by insert molding the diffuser onto the exterior or interior surface. A clear lens may include a diffractive or repeated geometric pattern rolled into an extrusion or molded into the surface at the time of manufacture. In another embodiment, the exit lens material itself may comprise a volumetric diffuser, such as an added colorant or particles having a different index of refraction, for example.

In other embodiments, the exit lens 104 may be used to optically shape the outgoing beam with the use of microlens structures, for example. Microlens structures are discussed in detail in U.S. patent application Ser. No. 13/442,311 to Lu, et al., which is commonly assigned with the present application to CREE, INC. and incorporated by reference herein.

Many different kinds of beam shaping optical features can be included integrally with the exit lens 104. Some exemplary lens textures for use in fixture embodiments of the present invention are shown in FIGS. 5-7. FIG. 5 shows various lens textures that may be used for the exit lens 104. Each of the lenses 502, 504, 506, 508 is textured on one side and with a pattern in one direction. The various contours each provide a different optical effect on the light that is transmitted, depending on the angle of incidence. FIG. 6 shows lens textures in another embodiment. The lenses 602, 604 are textured on one side and with a pattern in two directions. FIG. 7 shows lens textures on two sides with each side having a pattern in a different direction. Many different lens textures and combinations are possible in order to achieve a desired optical effect as the light passes through the exit lens 104.

For example, in one embodiment one longitudinal half of the exit lens 104 may comprise a textured lens to direct outgoing light in an upward direction while the other longitudinal half comprises a textured lens that directs light in a downward direction. Such an embodiment would be useful in a stairwell, for example, to light ascending and descending stairs with a single fixture.

Again with reference to FIG. 3, the fixture 100 comprises a sensor 108. Information from the sensor 108 is used to control the on/off state of the sources 122 to conserve energy when lighting in a particular area is not needed. The sensor may also be used to regulate the brightness of the sources, allowing for high and low modes of operation. In one embodiment, a passive infrared (PIR) sensor 108 is used to determine when a person is in the vicinity of the fixture 100 and thus would require light in the area. When the sensor detects a person, a signal is sent to the driver circuit and the lights are turned on, or if the lights remain on at all times, then the lights are switched to the high mode of operation. When the heat signature is no longer present, then the sources switch back to the default state (e.g., off or low mode). Many other types of sensors may be used such as a motion detector or an ultrasonic sensor, for example.

The sensor 108 may be adjusted between variable positions. In this embodiment, the sensor body 302 may be rotated about a post 304 across a range of angles (approximately 15 degrees) and locked into one of two selectable positions. Thus, the sensor can be arranged to an area where a person is most likely to be to improve the accuracy of the sensor 108. A pin 306 on the sensor body 302 snap-fits into one of two catch holes 308 on a sensor mount bracket 310 to hold the sensor body 302 into the selected position, although many other adjustment mechanisms may be used. The sensor 108 position is typically set during installation and is adjustable from inside the housing 102 to prevent tampering from the outside.

FIG. 8 shows a perspective view of the back side of the sensor 108 from within the housing 102 in one embodiment of the fixture 100. The space within the sensor body 302 is used to house the electronic components necessary to power the sensor 108. An electronics board 312 is used to mount the electronic components (not shown) within the sensor body 302. The electronic components are not shown as only the bottom side of the electronics board 312 is exposed from within the housing 102.

FIGS. 9*a* and 9*b* are exploded views of two subassemblies of an embodiment of the fixture 100. The two subassemblies may be assembled separately and then joined during installation to build the entire fixture 100.

FIG. 9 shows one embodiment of an electronics subassembly 900 and a lighting subassembly 920. The electronics subassembly comprises top and bottom housing pieces 902, 904 which may be attached using screws, for example, to form the housing 102. The housing pieces 902, 904 are held in place by the end caps 106. As best shown in FIG. 2*d*, the back surface of the housing 102 has several holes/slots for mounting the internal electronic component boxes. In this embodiment, the electronic component boxes comprise a backup battery box 906, a driver box 908, and a step-down converter box 910. The step-down converter box 910 is an optional element that may be included in models requiring a non-standard voltage, for example, models for use in Canada. Many different mount arrangements are possible to accommodate the necessary electronic components within the housing 102, and many different combinations of electronic components may be used. The sensor 108 is also mounted to an interior surface of the bottom housing piece 904 such that it protrudes through the housing 102.

The lighting subassembly 920 comprises the back reflector 124, the heat sink 118, and the exit lens 104. The end caps 106 hold these elements in place relative to one another.

The electronics subassembly 900 is attached to the lighting subassembly 920 either before or during installation of the fixture 100. In one embodiment, the subassemblies 900, 920 are attached with hinges such that the lighting assembly may be rotatably lifted to expose the internal components as discussed in more detail herein. In another embodiment the two subassemblies 900, 920 may be securely attached such that the parts do not come apart without disassembly.

Figure 10A:
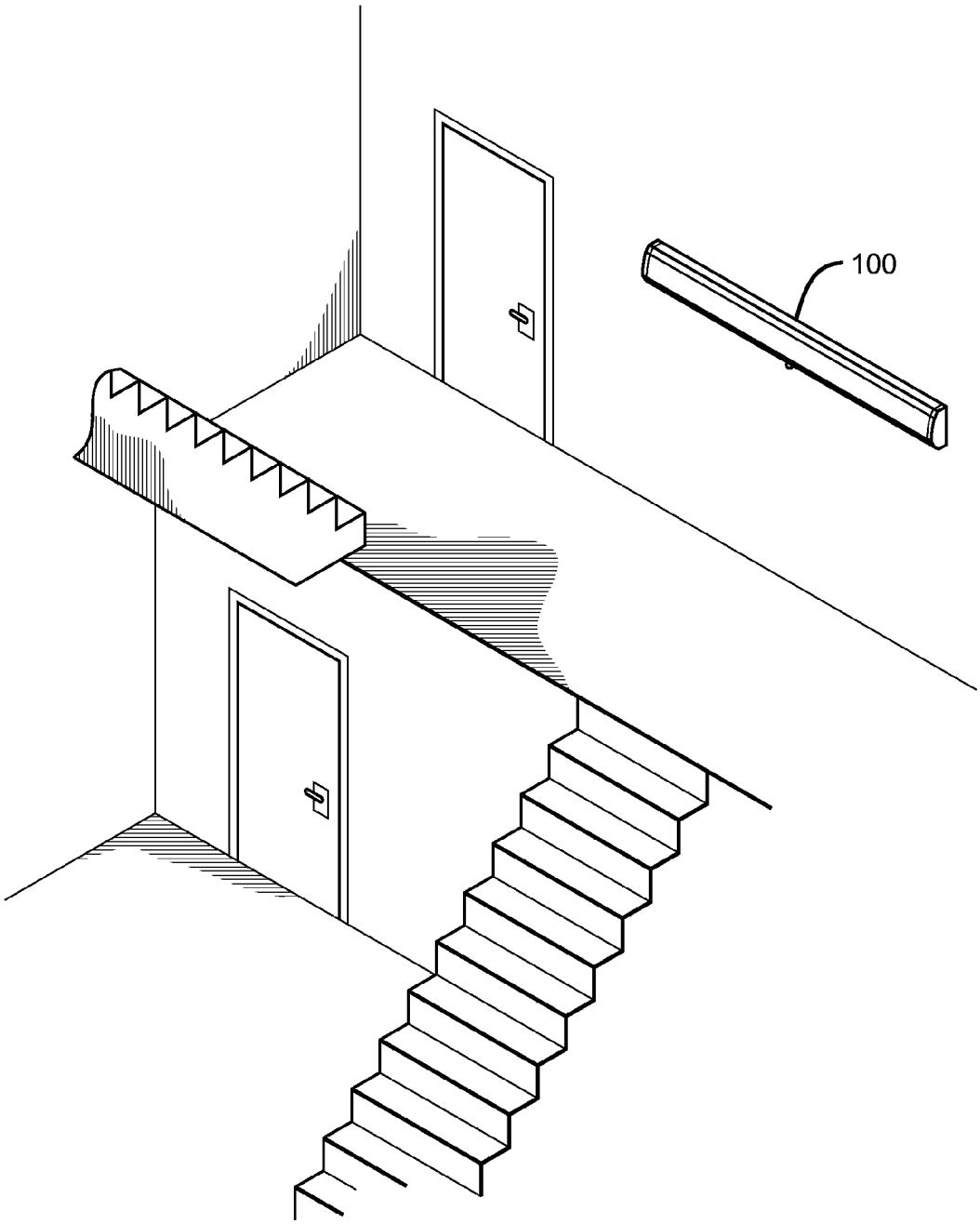
FIG. 10*a* shows a perspective view of a fixture according to an embodiment of the present invention installed in a stairwell environment.

FIG. 10*a* shows a perspective view of the fixture 100 installed in a stairwell environment. Although the fixture 100 is particularly well-suited for use in stairwells where the light needs to be directed more in specific zones along a vertical axis, the fixture 100 can be used in many different rooms or areas to produce a desired light distribution. In this embodiment, the fixture 100 is mounted to a wall within a stairwell. FIG. 10*b* shows how the horizontal and vertical axes are oriented with respect to the graph in FIG. 11.

FIG. 11 is a graph modeling on possible light output from the fixture 100. The relative intensity (in candela) of the light is shown over a range of vertical angles (degrees) for four different horizontal angle (degrees) values as shown in the legend and in FIG. 10*b*. The graph shows that for a horizontal angle of 0° (directly in front of the middle of the fixture), the intensity of the light peaks around 55° vertical and is concentrated in an area that is below 90° vertical. Thus, the majority of the output light is arranged downward. This is ideal for situations where more light is required to be projected outward and downward, such as in the stairwell environment shown in FIG. 10. The graph also shows that for an observation point off-center (e.g., horizontal angles of 30°, 60°, 90°), the relative intensity tails off quickly indicating that this embodiment of the fixture distributes the light primarily in an outward and downward direction.

FIG. 12 is a perspective view of a fixture 1200 according to another embodiment of the present invention. The fixture comprises a housing 1202 that surrounds the internal elements. An elongated heat sink 1204 runs from one end of the fixture to the other with first and second exit lenses 1206, 1208 extending from the edges of the heat sink 1204 out to the housing 1202.

FIG. 13 is a cross-sectional view of the fixture 1200. The first and second exit lenses 1206, 1208 are arranged on both sides of the heat sink 1204. The heat sink 1204 comprises a mount surface 1210 where one or more light sources can be mounted. An elongated asymmetric back reflector 1212 spans from one end of the housing 1202 to the other. The back reflector 1212 is opposite the heat sink mount surface 1210. The back reflector 1212 may be shaped in many different ways to redirect light from the sources through the exit lenses 1206, 1208 in a particular way. The back reflector 1212 and the interior walls of the housing 1202 form an enclosure 1214 that can be used to house electronics components.

In this embodiment, exit lenses 1206, 1208 extend from both sides of the heat sink 1204 to the bottom edge of the housing 1202. The back reflector 1212, heat sink 1204, and exit lenses 1206, 1208 at least partially define an interior cavity. In some embodiments, the light sources (not shown) may be mounted to a mount, such as a metal core board, FR4 board, printed circuit board, or a metal strip, such as aluminum, which can then be mounted to a separate heat sink, for example using thermal paste, adhesive and/or screws.

In this embodiment, the heat sink 1204 comprises fin structures on the bottom side (i.e., the room side). Although it is understood that many different heat sink structures may be used. The top side portion of the heat sink 1204 which is in the interior cavity comprises the mount surface 1210. The mount surface 1210 provides a substantially flat area on which light sources such as LEDs, for example, can be mounted. The sources can be mounted to emit in a primary direction orthogonal to the mount surface 1210, to emit in a primary direction toward the center region of the back reflector 1212, or they may be angled to emit in a primary direction toward other portions of the back reflector 1212.

The exposed heat sink 1204 is advantageous for several reasons. For example, air temperature in a typical residential/commercial room is much cooler than the air in the interior cavity, because the room environment must be comfortable for occupants. Additionally, room air is normally circulated, either by occupants moving through the room or by air conditioning. The movement of air throughout the room helps to break the boundary layer, facilitating thermal dissipation from the heat sink 1204.

The exit lenses 1206, 1208 can have the same or different optical properties to produce a desired distribution or effect. For example, the one of the exit lenses 1206, 1208 may be prismatic, diffusive, or one of both. Both exit lenses 1206, 1208 may be prismatic and tilted in the same or different directions. One lens may be more diffusive than the other. The lenses 1206, 1208 may be made of the same or different materials and may have the same or different thicknesses. Many different combinations of optical properties are possible to achieve a desired output.

FIG. 14 is a perspective view of another fixture 1400 according to an embodiment of the present invention. The fixture 1400 is similar to the fixture 1200 except that it comprises an end compartment 1402 which can house the electronic components necessary to drive the light sources. The compartment 1402 may also house other mechanical elements, such as a fan, for example.

FIG. 15 is a perspective view of another fixture 1500 according to an embodiment of the present invention. The fixture 1500 is similar to the fixture 1200 except that it comprises a housing 1502 having a top-side window 1504. The window 1504 allows some of the light emitted from the internal sources to escape out the top side of the housing 1502, providing up-light for the area above the fixture 1500 when it is mounted. The window 1504 may be a single transmissive region or a plurality of such regions. This configuration is particularly useful for embodiments of the fixture 1500 that are wall-mounted.

FIG. 16 is a perspective view of another fixture 1600 according to an embodiment of the present invention. The fixture 1600 is similar to the fixture 1500 except that it comprises a plurality of perforations 1604 on the top surface of the housing 1602. In this embodiment, the perforations 1604 provide the up-light. The perforations 1604 can comprise holes, slits, other cutaways, or any combination thereof.

FIG. 17 is a perspective view of another fixture 1700 according to an embodiment of the present invention. The fixture 1700 comprises a housing 1702 that provides the primary structure. An elongated heat sink 1704 is arranged proximate to a back reflector 1706 which runs in a longitudinal direction along the fixture 1700. At least one light source 1708 is disposed on a mount surface of the heat sink

1704 arranged such that a substantial portion of the light emitted from the source 1708 first impinges on said back reflector 1706. Electronic components necessary to operate the light sources 1708 may be housed within an enclosure 1710.

FIG. 18 is a cross-sectional view of the fixture 1700. This embodiment comprises a hemispherical exit lens 1802. As with the exit lenses in previous embodiments, the exit lens 1802 can function to mix outgoing light, to shape the beam, or to perform any other optical operations on the outgoing light before it impinges on the back reflector 1706. The exit lens 1802 may also function as a flame barrier in those embodiments using high voltage sources. The heat sink 1704 is exposed to the ambient air to provide a low resistance thermal path from the sources 1708 to the ambient air. The fixture 1700 can be mounted to a wall or a ceiling using conventional methods or can be suspended from a ceiling in a pendant configuration.

FIG. 19 shows a cross-sectional view of another fixture 1900 according to an embodiment of the present invention. The fixture 1900 comprises a housing 1902 that provides the primary structure. An elongated heat sink 1904 is arranged proximate to a back reflector 1906 which runs in a longitudinal direction along the fixture 1900. At least one light source 1908 is disposed on a mount surface of the heat sink 1904 such that a portion of the light emitted from the source 1908 first impinges on said back reflector 1906. In this particular embodiment, an exit lens extends 1910 from the heat sink 1904 to the back reflector 1906 such that the light sources are completely enclosed. Thus, the exit lens 1910 may also function as a flame barrier if high voltage light sources are used. The exit lens 1910 may also function optically to diffuse outgoing light or shape the beam. Electronic components necessary to operate the light sources 1908 may be housed within an enclosure 1912.

FIG. 20 shows a bidirectional fixture 2000 according to an embodiment of the present invention. The fixture 2000 comprises first and second longitudinal portions 2002, 2004 with the first portion 2002 arranged to emit light in a first direction and the second portion 2004 arranged to emit light in a second direction. The bidirectional fixture 2000 can comprise many different fixtures such as those previously disclosed (e.g., fixture 100, fixture 1200, fixture 1700). The two portions 2002, 2004 are rotatably joined such that they may be easily adjusted to project light into different directions. The two portions 2002, 2004 may be identical fixtures or they may be different; for example, they may have different lengths or different optical properties. The bidirectional fixture 2000 may be mounted to a wall or ceiling at its ends such that the portions 2002, 2004 can be rotated after installment. The bidirectional fixture 2000 is particularly well-suited for lighting spaces having different elevations such as a stairwell, for example, where the stairs ascending and descending from the level need to be lit.

Figure 21:
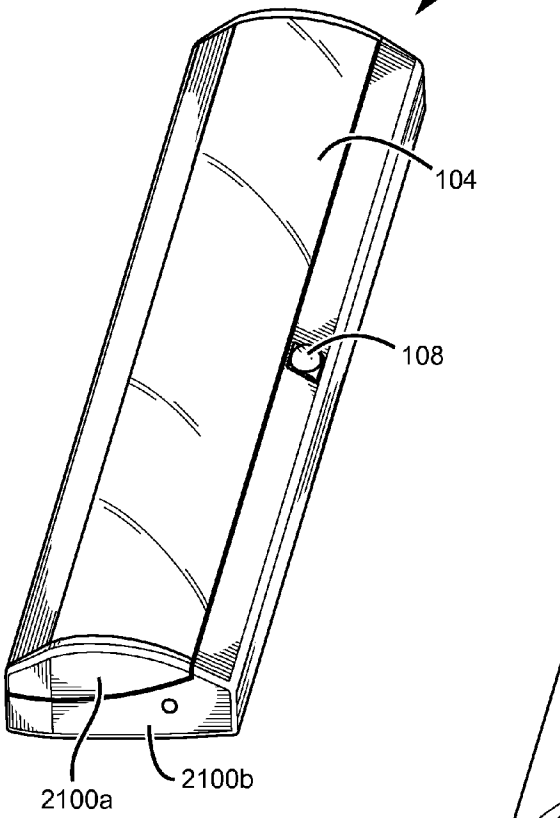
FIG. 21 shows a perspective view of another fixture according to an embodiment of the present invention.

FIG. 21 shows a perspective view of another fixture 2100 according to an embodiment of the present invention. The fixture 2100 is similar to the fixture 100 in many respects and has many of the same elements as indicated by the common reference numerals. In this embodiment, the fixture 2100 comprises two discrete subassembly components 2100*a*, 2100*b* (shown in FIG. 22) that are rotatably attached about a hinge. This allows the fixture 2100 to be opened providing access to the internal elements even after installation. This particular embodiment has a length of 2 ft; however, the fixture 2100 scales easily to other lengths. Additionally, multiple fixtures may be installed side by side to create longer effective fixture lengths.

Figure 22:
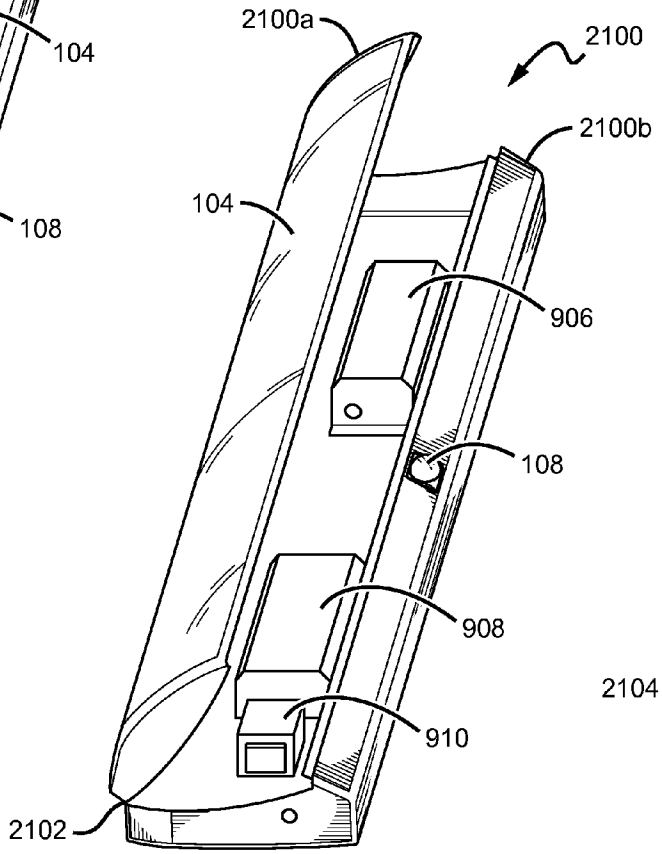
FIG. 22 shows a perspective view of the fixture in the open configuration according to an embodiment of the present invention.

FIG. 22 shows a perspective view of the fixture 2100 in the open configuration. The two subassemblies 2100*a* (lighting subassembly), 2100*b* (electronics subassembly) open about a hinge 2102 to reveal the internal components. This particular embodiment comprises a backup battery box 906, a driver box 908, and a step-down converter box 910.

Figure 23:
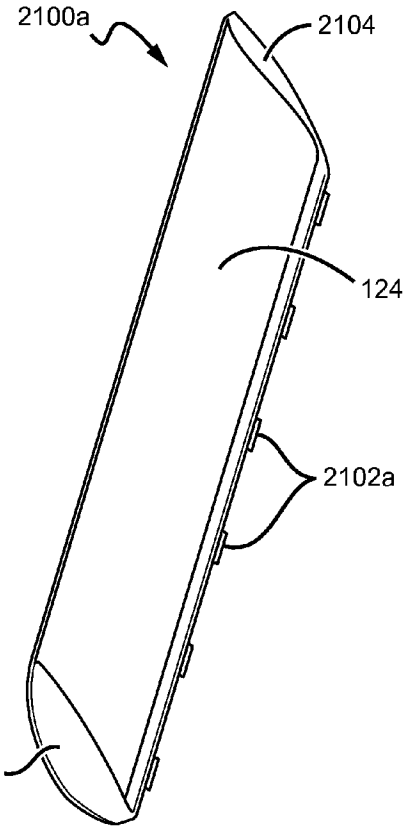
FIG. 23 shows a perspective view of a lighting subassembly with the electronics subassembly removed according to an embodiment of the present invention.

FIG. 23 shows a perspective view of the lighting subassembly 2100*a* with the electronics subassembly 2100*b* removed. The back surface of the back reflector 124 is visible in this view. The male portion of the hinge 2102*a* is disposed along the edge of the subassembly 2100*a*. End caps 2104 hold the internal elements of the lighting subassembly 2100*a* together.

Figure 24:
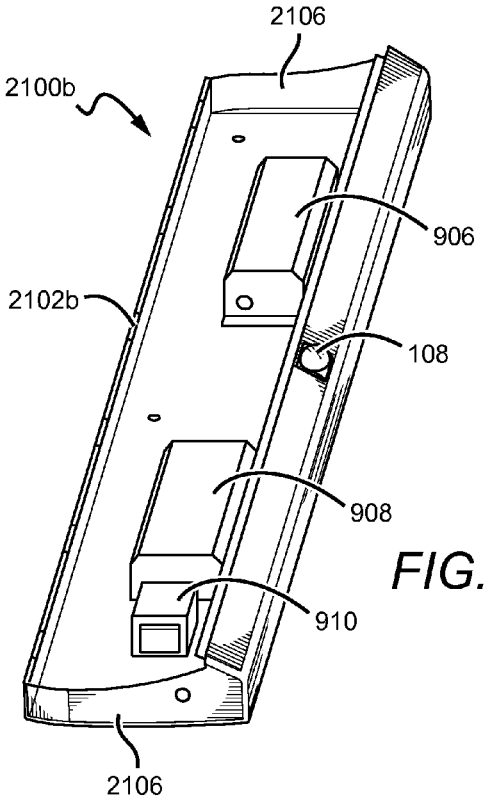
FIG. 24 shows a perspective view of the electronics subassembly with the lighting subassembly removed according to an embodiment of the present invention.

FIG. 24 shows a perspective view of the electronics subassembly 2100*b* with the lighting subassembly 2100*a* removed. The female portion of the hinge 2102*b* is disposed along the top edge of the subassembly 2100*b*. End caps 2106 are disposed at both ends of the subassembly 2100*b*.

Figure 25:
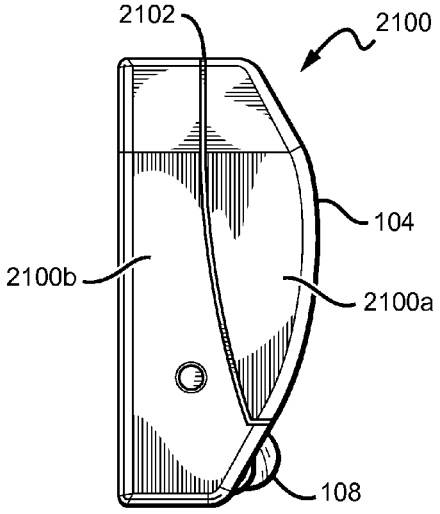
FIG. 25 is a left side perspective view of the fixture in the closed configuration according to embodiments of the present invention.
Figure 26:
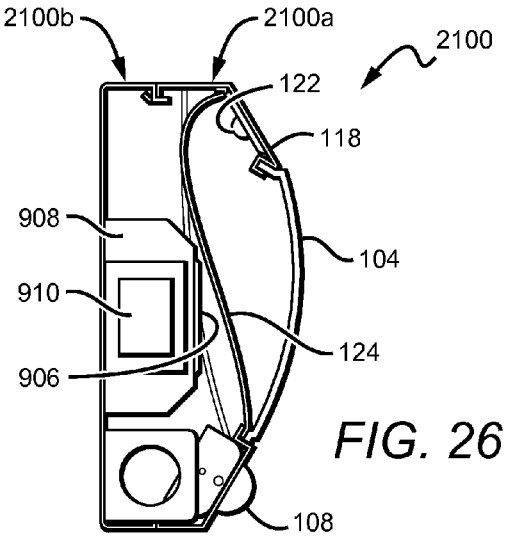
FIG. 26 is also a left side view of the fixture in the closed configuration but with the end cap removed to reveal the internal elements according to embodiments of the present invention.

FIG. 25 is a left side perspective view of the fixture 2100 in the closed configuration. FIG. 26 is also a left side view of the fixture 2100 in the closed configuration but with the end cap removed to reveal the internal elements. The internal elements are shown in phantom so that all the elements are visible; the exemplary longitudinal placement of the elements along the fixture 2100 is shown in FIG. 24. As shown, the lighting subassembly 2100*a* comprises the exit lens 104, the back reflector 124, the heat sink 118, and at least one light source 122. The electronics subassembly comprises the sensor 108 and the other electronic components 906, 908, 910. The two subassemblies are rotatably attached at one end about the hinge 2102.

Figure 27:
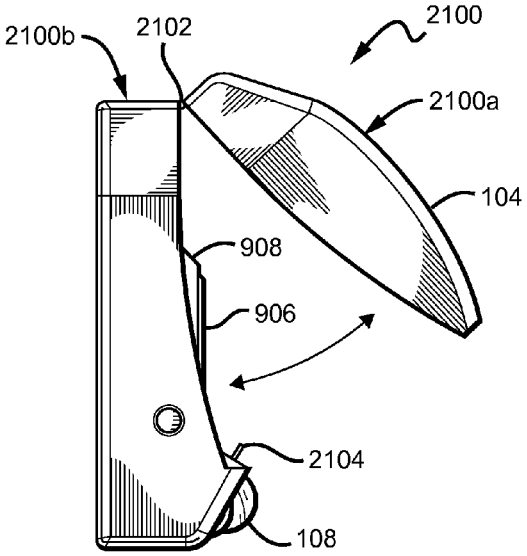
FIG. 27 shows a left side perspective view of the fixture in the open configuration according to embodiments of the present invention.

FIG. 27 shows a left side perspective view of the fixture 2100 in the open configuration. As shown, the internal elements are accessible when the fixture 2100 is open. This allows for easy replacement and/or repair of the internal elements without the need to disassemble the fixture 2100 and remove it from the wall or ceiling to which it is mounted. Some of the internal electronic components 906, 908 are visible from the side view. When the fixture is closed, the subassemblies may be held together with many different latch-type mechanisms. In this embodiment, a releasable latch 2104 is used. The latch 2104 may be released with a button or with a push open/push close mechanism, for example.

There are many different housing subassembly and lighting subassembly combinations that can be used to provide various light output distributions. Several such configurations are discussed in U.S. patent application Ser. No. 13/830,698 titled "LINEAR LIGHT FIXTURE WITH INTERCHANGEABLE LIGHT ENGINE UNIT" to Dungan et al., filed on [DATE], which is commonly owned with the present application by Cree, Inc. and incorporated by reference herein.

Fixtures according to embodiments disclosed herein provide an asymmetric light distribution. The back reflector, the exit lens, and the light sources can be arranged in many different configurations to achieve a desired asymmetric output. FIGS. 28-34 show several different configurations that may be incorporated into fixtures according to various embodiments of the present invention.

Figure 28:
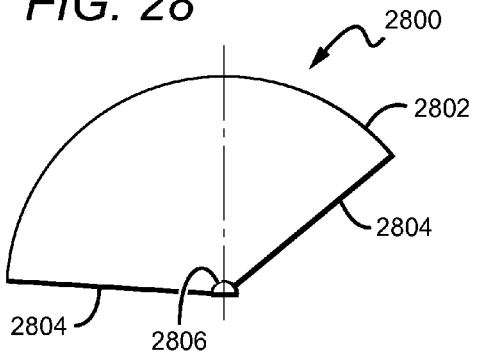
FIG. 28 shows a cross-sectional view of an optical assembly that may be used in fixtures according to embodiments of the present invention.

FIG. 28 shows a cross-sectional view of an optical assembly 2800 that may be used in fixtures according to embodiments of the present invention. In this embodiment, a back reflector 2802 extends farther in the transverse direction on one side of a light source 2806. The exit lenses 2804 extend from both sides of the light source 2806 to the back reflector 2802.

Figure 29:
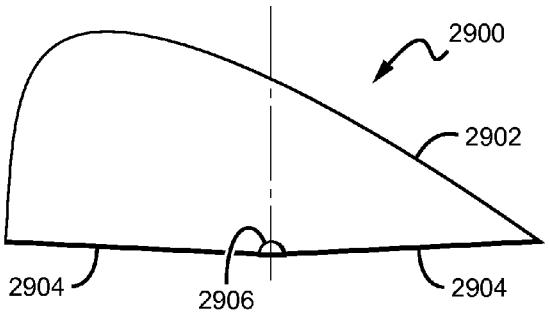
FIG. 29 shows a cross-sectional view of an optical assembly that may be used in fixtures according to embodiments of the present invention.

FIG. 29 shows a cross-sectional view of an optical assembly 2900 that may be used in fixtures according to embodiments of the present invention. In this embodiment, a back reflector 2902 comprises a surface having an asymmetric transverse cross-section. Exit lenses 2904 extend from both sides of a light source 2906 to the back reflector 2902.

Figure 30:
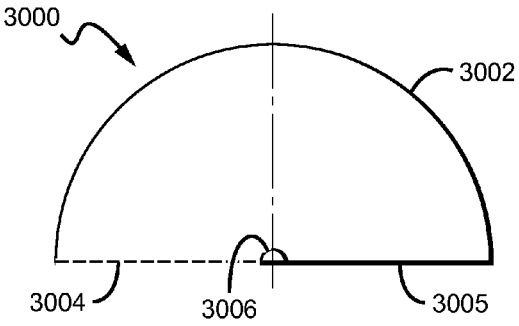
FIG. 30 shows a cross-sectional view of an optical assembly that may be used in fixtures according to embodiments of the present invention.

FIG. 30 shows a cross-sectional view of an optical assembly 3000 that may be used in fixtures according to embodiments of the present invention. In this embodiment, exit lenses 3004, 3005 extend symmetrically from both sides of a light source 3006 to a back reflector 3002; however, the exit lenses 3004, 3005 have different optical properties as previously discussed herein.

Figure 31:
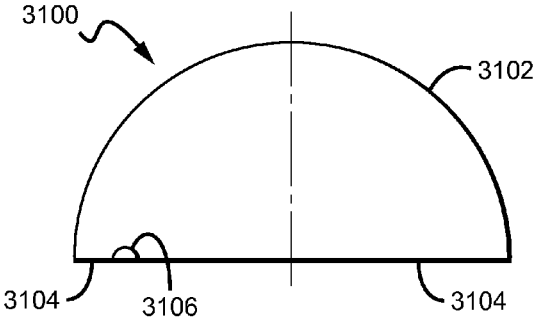
FIG. 31 shows a cross-sectional view of an optical assembly that may be used in fixtures according to embodiments of the present invention.

FIG. 31 shows a cross-sectional view of an optical assembly 3100 that may be used in fixtures according to embodiments of the present invention. In this embodiment, a light source 3106 is disposed off-center relative to the central longitudinal axis. Exit lenses 3104 extend from both sides of the light source 3106 to a back reflector 3102.

Figure 32:
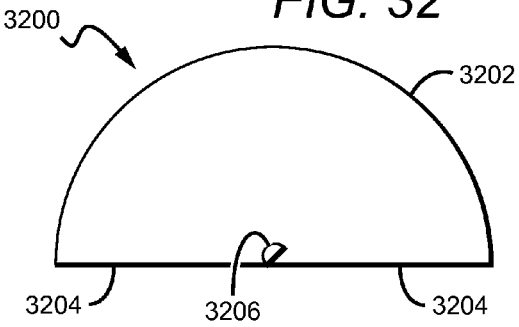
FIG. 32 shows a cross-sectional view of an optical assembly that may be used in fixtures according to embodiments of the present invention.

FIG. 32 shows a cross-sectional view of an optical assembly 3200 that may be used in fixtures according to embodiments of the present invention. In this embodiment, a light source 3206 is arranged to emit in a primary direction at an angle that is off-center with respect to a back reflector 3202. Exit lenses 3204 extend from both sides of the light source 3206 to the back reflector 3202.

Figure 33:
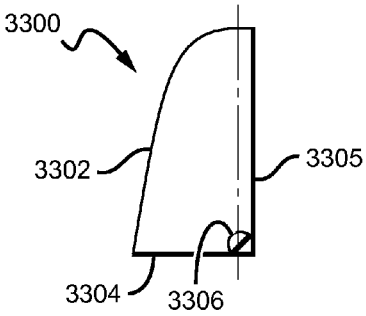
FIG. 33 shows a cross-sectional view of an optical assembly that may be used in fixtures according to embodiments of the present invention.

FIG. 33 shows a cross-sectional view of an optical assembly 3300 that may be used in fixtures according to embodiments of the present invention. This embodiment includes a combination of asymmetric elements from the previous configurations. A back reflector 3302 having an asymmetric transverse cross-section extends farther in the transverse direction on one side of a light source 3306. Additionally, a light source 3306 is arranged to emit in a primary direction that is off-center with respect to the back reflector 3302. Exit lenses 3304, 3305 extend different lengths and in different directions from both sides of the light source 3306 to the back reflector 3302.

The optical assemblies shown in FIGS. 28-33 are meant to be exemplary and to convey general structures that may be incorporated into fixtures according to embodiments of the present invention. Many different combinations of the previous structural configurations may be used to create a particular output profile.

Figure 34A:
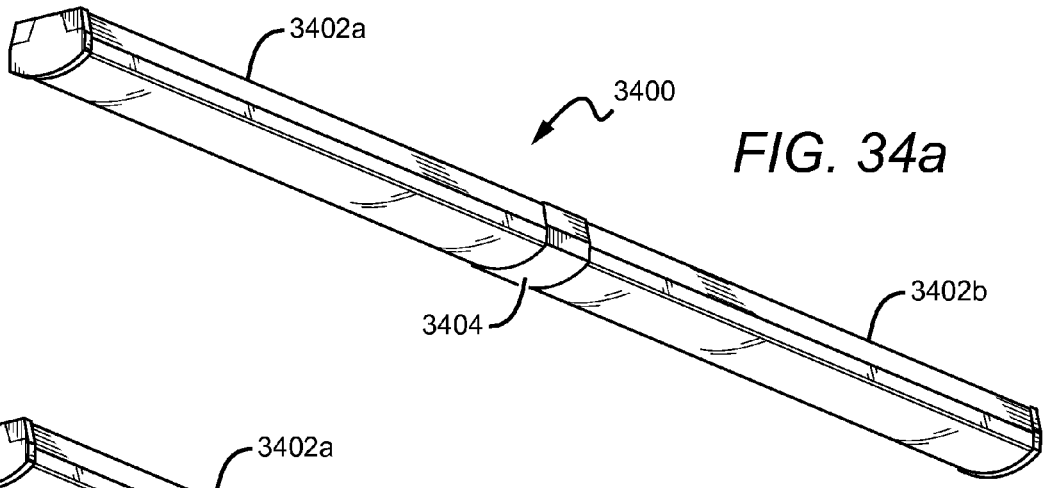
FIGS. 34*a-c* show an embodiment of an extended modular fixture according to an embodiment of the present invention.
Figure 34B:
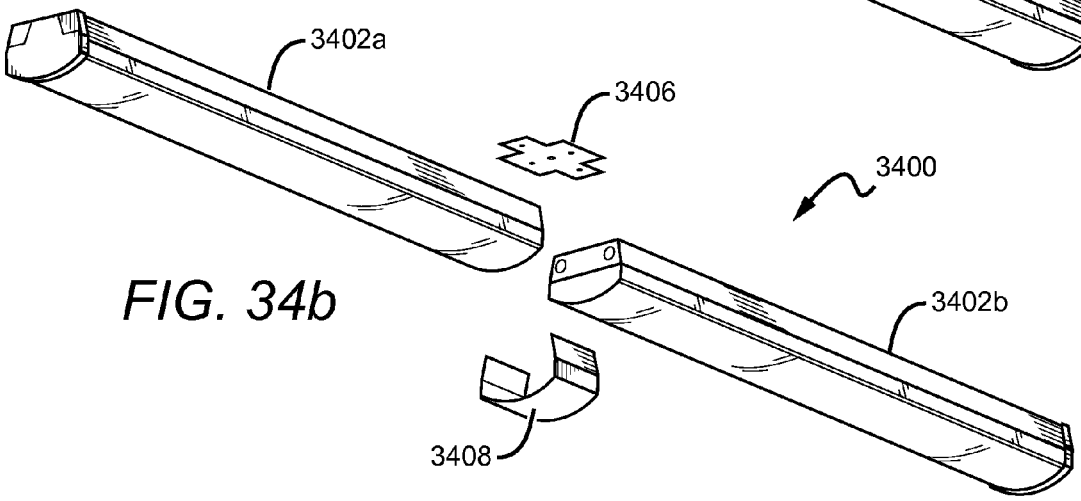
Figure 34C:
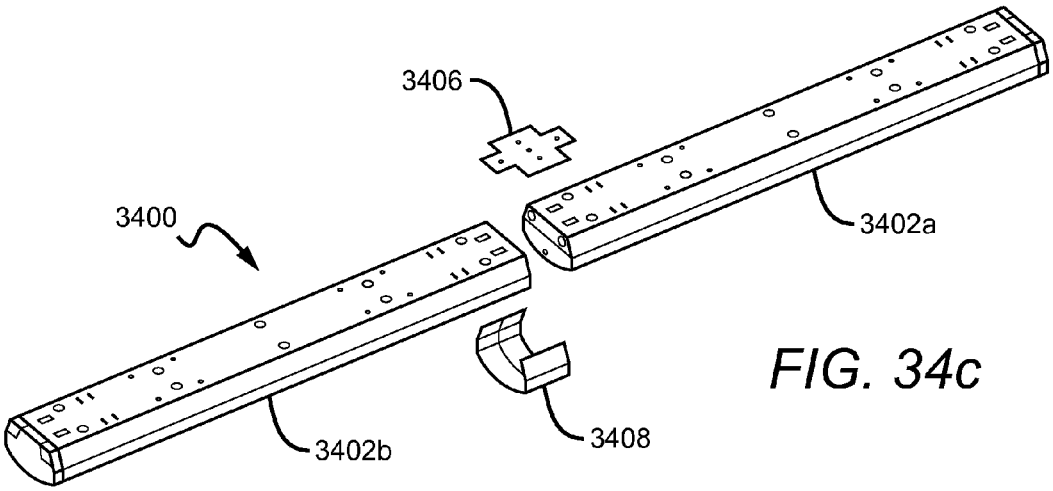

FIGS. 34*a-c* show an embodiment of an extended modular fixture 3400. FIG. Two smaller linear fixtures 3402*a*, 3402*b*, which are similar to the fixture 1400 in many respects, have been attached together to form the extended fixture 3400. The intermediate joiner plate 3404 provides the attachment mechanism. The individual fixtures 3402*a*, 3402*b* can be separately connected to a power sources or then can be serially connected with wires passing through the joiner structure 3404 to complete the electrical connection. In this way, additional fixtures may be added to the ends to extend the fixture 3400 in either direction, for example, to light a continuous corridor. FIGS. 34*a* and 34*b* show the fixture 3400 before the small fixtures 3402*a*, 3402*b* have been connected. The joiner structure comprises mount plate 3406 and a sleeve 3408. The mount plate is attached using screws, for example, to the fixtures 3402*a*, 3402*b*, and the sleeve 3408 wraps around to cover the interface. The extended modular fixture 3400 is a ceiling-mounted embodiment. However, it is understood that fixtures may be mounted using other methods, for example, wall-mount, surface-mount, or pendant-mount configurations. Such fixtures may be similarly joined together to create an extended modular fixture having a particular desired length.

It is understood that embodiments presented herein are meant to be exemplary. Embodiments of the present invention can comprise any combination of compatible features shown in the various figures, and these embodiments should not be limited to those expressly illustrated and discussed. Many other versions of the configurations disclosed herein are possible. Thus, the spirit and scope of the invention should not be limited to the versions described above.

We claim:

1. A light fixture, comprising:

an elongated back reflector;

at least one light source that emits light that is incident on said back reflector;

a first exit lens arranged to receive at least some light redirected from said back reflector; and a second exit lens arranged to receive at least some light redirected from said back reflector;

wherein said light fixture provides an asymmetric light distribution.

2. The light fixture of claim 1, wherein said at least one light source is on a mount surface of an elongated heat sink arranged proximate to said back reflector and running in a longitudinal direction.

3. The light fixture of claim 1, wherein said back reflector extends farther in the transverse direction on one side of said at least one light source than on the other side.

4. The light fixture of claim 1, wherein said back reflector comprises a surface having an asymmetric transverse cross-section.

5. The light fixture of claim 1, wherein said at least one light source is disposed off-center relative to a central longitudinal axis.

6. The light fixture of claim 1, wherein said at least one light source is arranged to emit light in a primary direction at an angle that is off-center with respect to said back reflector.

7. The light fixture of claim 1, wherein said first and second exit lenses are on opposite sides of said at least one light source.

8. The light fixture of claim 1, wherein said first and second exit lenses have different optical properties.

9. The light fixture of claim 1, wherein said first exit lens is prismatic and said second exit lens is diffusive.

10. The light fixture of claim 1, wherein said first exit lens is prismatic and tilted in a first direction and said second exit lens is prismatic and tilted in a second direction.

11. The light fixture of claim 1, wherein said first exit lens comprises a first material and said second exit lens comprises a second material.

12. The light fixture of claim 1, wherein said first exit lens has a first thickness and said second exit lens has a second thickness.

13. The light fixture of claim 1, wherein said first exit lens has a first diffusiveness and said second exit lens has a second diffusiveness.

14. The light fixture of claim 1, wherein said at least one light source is arranged to emit light in a primary direction at an angle that is off-center with respect to said back reflector.

15. The light fixture of claim 1, further comprising a mount structure for mounting said fixture to a surface.

16. The light fixture of claim 1, wherein said fixture comprises first and second longitudinal portions, said first portion arranged to emit light in a first direction and said second portion arranged to emit light in a second direction.

17. The light fixture of claim 1, wherein said back reflector comprises a diffusive interior surface.

18. The light fixture of claim 1, wherein said back reflector comprises a textured interior surface.

19. The light fixture of claim 1, wherein said back reflector comprises an interior surface that is at least partially specular.

20. The light fixture of claim 1, further comprising a driver circuit connected to control said at least one light source.

21. The light fixture of claim 1, wherein said elongated back reflector comprises an asymmetric transverse cross-section.

22. The light fixture of claim 1, further comprising a housing that partially surrounds said back reflector, said exit lenses, and said at least one light source.

23. The light fixture of claim 22, said housing comprising a driver enclosure that surrounds a driver circuit.

24. The light fixture of claim 22, said housing comprising a transmissive portion to provide up-light.

25. The light fixture of claim 22, said housing comprising a perforated portion arranged to provide up-light.

26. A light fixture, comprising:

a housing at least partially defining an internal cavity;

a back reflector comprising an asymmetric transverse cross-section and at least partially surrounded by said housing;

a heat sink comprising a mount surface;

a plurality of light sources on said mount surface and at least partially within said internal cavity, said light sources arranged to emit light such that at least a portion of light from said light sources is initially incident on said back reflector;

driver electronics at least partially within said internal cavity; and end caps on opposite ends of said back reflector and said heat sink and holding said back reflector and said heat sink in position relative to one another;

wherein said back reflector is asymmetric relative to said primary emission direction.

27. The light fixture of claim 26, wherein said back reflector extends farther in the transverse direction on one side of said light sources than on the other side.

28. The light fixture of claim 26, wherein said light sources are disposed off-center relative to a central longitudinal axis.

29. The light fixture of claim 26, wherein said light sources are arranged to emit in a primary direction at an angle that is off-center with respect to said back reflector.

30. The light fixture of claim 26, wherein said back reflector comprises a semi-specular reflective interior surface.

31. The light fixture of claim 26, wherein said back reflector comprises a diffuse reflective interior surface.

32. The light fixture of claim 26, wherein said back reflector comprises a textured interior surface.

33. The light fixture of claim 26, wherein said housing comprises first and second longitudinal portions, said first portion arranged to emit light in a first direction and said second portion arranged to emit light in a second direction.

34. The light fixture of claim 26, further comprising a lens on said mount surface and over said light sources.

35. The light fixture of claim 26, said housing comprising a driver enclosure that surrounds a driver circuit.

36. The light fixture of claim 26, said housing comprising a transmissive portion to provide up-light.

37. The light fixture of claim 26, said housing comprising a perforated portion arranged to provide up-light.

38. The light fixture of claim 26, further comprising a driver circuit connected to control said light sources.

39. The light fixture of claim 26, further comprising first and second exit lenses extending from both sides of said mount surface toward said back reflector.

40. The light fixture of claim 39, wherein said first exit lens has different optical properties than said second exit lens.

41. A light fixture, comprising:

a housing;

a back reflector at least partially surrounded by said housing;

a mount surface proximate to said back reflector;

an exit lens between said back reflector and said mount surface; and at least one light source on said mount surface and arranged to emit light such that a first portion of said light initially impinges on said back reflector and a second portion of said light initially impinges on said exit lens.

42. The light fixture of claim 41, wherein said back reflector comprises a semi-specular reflective interior surface.

43. The light fixture of claim 41, wherein said back reflector comprises a diffuse reflective interior surface.

44. The light fixture of claim 41, wherein said back reflector comprises a textured interior surface.

45. The light fixture of claim 41, wherein said exit lens is prismatic.

46. The light fixture of claim 41, further comprising a driver circuit to control said at least one light source.

47. The light fixture of claim 46, said housing comprising a driver enclosure that surrounds said driver circuit.

48. An elongated light fixture, comprising:

a lighting subassembly, comprising:

a lens plate;

an asymmetric back reflector;

a heat sink comprising a mount surface;

at least one light source on said mount surface and arranged to emit toward said back reflector, said back reflector arranged to redirect at least a portion of impinging light toward said lens plate; and end caps on both ends of said lens plate, said back reflector, and said heat sink, said end caps holding said lens plate, said back reflector, and said heat sink in position relative to one another; and an electronics subassembly, comprising:

an elongated housing at least partially defining an internal cavity; and driver electronics mounted to said housing within said cavity;

wherein said lighting subassembly attaches to said electronics subassembly such that said back reflector and said at least one light source are within said internal cavity.

49. The elongated light fixture of claim 48, further comprising a sensor mounted to said housing and connected to said driver electronics.

50. The elongated light fixture of claim 48, wherein said lighting subassembly and said electronics subassembly are rotatably attached at one end about a hinge such that said fixture has an open configuration and a closed configuration.

51. The elongated light fixture of claim 50, further comprising a releasable latch to hold said lighting subassembly and said electronics subassembly together when said fixture is in said closed configuration.

* * * * *